US007208030B2

(12) United States Patent
Totoki

(10) Patent No.: US 7,208,030 B2
(45) Date of Patent: Apr. 24, 2007

(54) SUSPENDED PARTICULATE ANALYZER

(75) Inventor: Shinichiro Totoki, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 4 days.

(21) Appl. No.: 11/221,877

(22) Filed: Sep. 9, 2005

(65) Prior Publication Data

US 2006/0081127 A1 Apr. 20, 2006

(30) Foreign Application Priority Data

Oct. 15, 2004 (JP) ..... 2004-300915

(51) Int. Cl.
*B03C 3/68* (2006.01)

(52) U.S. Cl. ..... 96/19; 95/3; 95/73; 95/78; 96/26; 96/60; 96/63

(58) Field of Classification Search ..... 95/63, 95/67, 70, 73, 2–4, 78; 96/26, 55, 60, 62–63, 96/18, 19; 55/282.2, DIG. 10
See application file for complete search history.

(56) References Cited

U.S. PATENT DOCUMENTS

| | | | | |
|---|---|---|---|---|
| 1,884,085 | A * | 10/1932 | Miller | 95/4 |
| 2,209,798 | A * | 7/1940 | Subkow | 208/350 |
| 3,768,302 | A * | 10/1973 | Barringer | 73/28.01 |
| 3,807,137 | A * | 4/1974 | Romell | 95/72 |
| 5,557,923 | A * | 9/1996 | Bolt et al. | 60/274 |
| 6,129,781 | A * | 10/2000 | Okamoto et al. | 96/25 |
| 6,156,099 | A * | 12/2000 | Hironaka et al. | 95/74 |
| 6,251,170 | B1 * | 6/2001 | Hironaka et al. | 96/28 |
| 6,674,528 | B2 * | 1/2004 | Adachi et al. | 356/336 |
| 6,807,874 | B2 * | 10/2004 | Totoki | 73/864.71 |
| 6,824,587 | B2 * | 11/2004 | Mohamed | 95/7 |
| 6,881,246 | B2 * | 4/2005 | Totoki | 96/26 |
| 6,904,787 | B2 * | 6/2005 | Totoki | 73/28.04 |
| 6,923,848 | B2 * | 8/2005 | Totoki | 96/26 |
| 7,041,153 | B2 * | 5/2006 | Totoki | 95/3 |
| 2001/0025570 | A1 * | 10/2001 | Fukushima | 95/57 |

FOREIGN PATENT DOCUMENTS

| | | | |
|---|---|---|---|
| JP | 52-26079 | * | 2/1977 |
| JP | 2003-215021 | * | 7/2003 |
| JP | 2003-337087 | * | 11/2003 |

* cited by examiner

*Primary Examiner*—Richard L. Chiesa
(74) *Attorney, Agent, or Firm*—Manabu Kanesaka

(57) ABSTRACT

An apparatus analyzes components of particulate materials suspended in air. The apparatus includes a container into which the air is introduced, a discharging electrode arranged in the container to electrically charge the particulate materials contained in the air, a dust collecting electrode arranged in the container to collect charged particulate materials utilizing electric potential difference, and a device for separating volatile components contained in the particulate materials collected on the dust collecting electrode. A gas analyzer is connected to the container into which the volatile components of the particulate materials separated in the container are introduced, to analyze the volatile components.

10 Claims, 1 Drawing Sheet

SUSPENDED PARTICULATE ANALYZER

BACKGROUND OF THE INVENTION AND RELATED ART STATEMENT

The present invention relates to an apparatus for analyzing particulate matter or materials suspended in the atmosphere.

In the particulates suspended in air or atmosphere, those having aerodynamic particle diameters below 10 μm are referred to as suspended particulate materials (SPM). Although soil entrained in air is also included, suspended particulate materials are composed predominantly of diesel smoke, incompletely burned fuel, and sulfur compounds (35% originate from diesel powered vehicles in the Kanto region in Japan), and is highly harmful. The particulate materials attributable to diesel emissions are referred to particularly as DPE. Particulate materials with an aerodynamic diameter below 2.5 μm are referred to as micro-particulate materials (PM2.5), which have been investigated or researched vigorously in the United States and Europe. In the case of PM2.5, the percentage of diesel powered vehicles as emission sources is believed to be even higher.

As an apparatus for collecting such particulate materials suspended in the atmosphere, one that utilizes an impactor is well known. The apparatus with an impactor collects particles by separating them from a flowing mass that is collided with a collecting plate, thereby rapidly changing the direction of the air flow. Since such an apparatus utilizing the impactor cannot collect particles in the submicron- to nano-particle range, the present inventor has proposed a method in which air is introduced into a container, a discharging electrode to generate mono-polar ions and a dust collecting electrode having an electric potential difference relative to the discharging electrode are arranged in the container, the particulate materials contained in the air introduced into the container is electrically charged by mono-polar ions, and the charged particulate materials are collected on the dust collecting electrode and made available for various measurements and analyses (see, for example, patent reference 1).

The present inventor, moreover, has also proposed an apparatus including a differential mobility analyzer (DMA) disposed at an air inlet of the above described container having the discharging and collecting electrodes disposed therein. The differential mobility analyzer utilizes differences in mobility of particles based on their particle size, and, by using an electric field, allows only the particulate materials falling within a selected particle size range to pass. Thus, only the particulate materials falling within the selected particle size range are collected on a collecting electrode (see patent reference 2).

Patent Reference 1: Japanese Patent Laid-out Publication No. 2003-215021

Patent Reference 2: Japanese Patent Laid-out Publication No. 2003-337087

In case of analyzing the components, particularly volatile components, of particulate materials suspended in the atmosphere, an analysis using an analyzer, such as a gas chromatograph, for example, must be carried out on the particulate materials collected. In the case wherein a conventional apparatus having an impactor is used to collect particulate materials, the aforementioned submicron- to nano-particle range particulate materials can not be collected. Moreover, as the apparatus is incapable of collecting particulate materials under atmospheric pressure (collects under reduced pressure), the volatile components of particles can be lost.

The apparatuses disclosed in patent references 1 and 2, on the other hand, can collect submicron- to nano-particle range particulate materials, and do not lose volatile components since the collection is carried out under atmospheric pressure.

In cases wherein particulate materials are collected by using the apparatuses disclosed in patent references 1 and 2, however, the dust collecting electrode must be removed by opening the container after collecting particulate materials on the dust collecting electrode over a certain period of time for an analysis using an analyzer. This can be extremely labor intensive, and thus impractical, when conducting a time-series analysis that focuses on changes in the components of particulate materials over a prolonged period of time.

The present invention has been proposed in view of such situations, and it is an object of the invention to provide an apparatus for analyzing suspended particulate materials capable of accommodating time-series analyses of the volatile components of particulate materials suspended in the atmosphere.

It is another object of the present invention to provide an apparatus for analyzing particulate materials suspended in the atmosphere capable of analyzing the volatile components of particulate materials according to particle size.

SUMMARY OF THE INVENTION

In order to achieve the first objective described above, the apparatus for analyzing suspended particulate materials according to the present invention comprises a container into which air is introduced, a discharging electrode arranged in said container to electrically charge particulate materials contained in the air, a dust collecting electrode arranged in said container to collect charged particulate materials utilizing electric potential difference, heating means for heating said dust collecting electrode to separate volatile components of the particulate materials collected on said dust collecting electrode, and a gas analyzer connected with said container into which the volatile components of the particulate materials separated within said container are introduced (first aspect).

In order to achieve the second objective, the invention of a second aspect employs a construction that arranges a differential mobility analyzer at the air inlet of the container for selecting a particle size range for the particulate materials suspended in the air to be introduced in said container.

The invention in the first or second aspect may be so configured to sequentially volatilize the components, from low boiling point components to high boiling point components, to be introduced into the gas analyzer by changing the heating temperatures of the heating means (third aspect).

Alternatively, the heating means in the invention in the first or second aspect may be replaced with a pressure reducing means to depressurize the container to gasify the volatile components (fourth aspect).

The present invention achieves the aforementioned objectives by employing a method of electrostatically collecting charged suspended particulate materials on a dust collecting electrode, which enables the collection of submicron- to nano-particle range particulate materials, separating the volatile components in the container by heating the particulate materials collected on the dust collecting electrode or depressurizing the container, and introducing the separated volatile components into a gas analyzer connected to the container.

In other words, the container, which includes the discharging electrode to charge particulate materials and the dust collecting electrode with a different potential from the discharging electrode to collect charged particulate materials, is connected to the gas analyzer. The container is provided with a capability to separate volatile components from the collected particulate materials by heating the particulate materials collected on the collecting electrode or providing means for depressurizing the container. Thus, it is possible to repeat the steps of collecting particulate materials, separating volatile components, and analyzing. This enables continuous (intermittent) analyses of the volatile components of particulate materials suspended in the atmosphere over a prolonged period of time.

Moreover, arranging a differential mobility analyzer at the air inlet of the container, as in the invention in the second aspect, enables the selection of particle size of particulate materials in the atmosphere to be introduced into the container, thereby enabling analyses of volatile components according to the particle size. In the case wherein the heating means is employed as means for separating volatile components, analyses of the components of collected particulate materials can be performed for boiling point components, from low boiling point components to high boiling point components, by changing the heating temperatures.

According to the present invention, changes of the volatile components in particulate materials suspended in the atmosphere, including those in the submicron- to nano-particle range, can be detected along the elapse of time.

Moreover, disposing a differential mobility analyzer at the gas inlet of the container, as in the invention in the second aspect, makes it possible to individually analyze the volatile components of suspended particulate materials according to particle size, and obtain data on nano-particles, in particular, such as a source, generation process, and toxicity level per particle size thereof, that were not obtainable with a conventional method or apparatus.

DETAILED DESCRIPTION OF PREFERRED EMBODIMENTS

Figure 1:
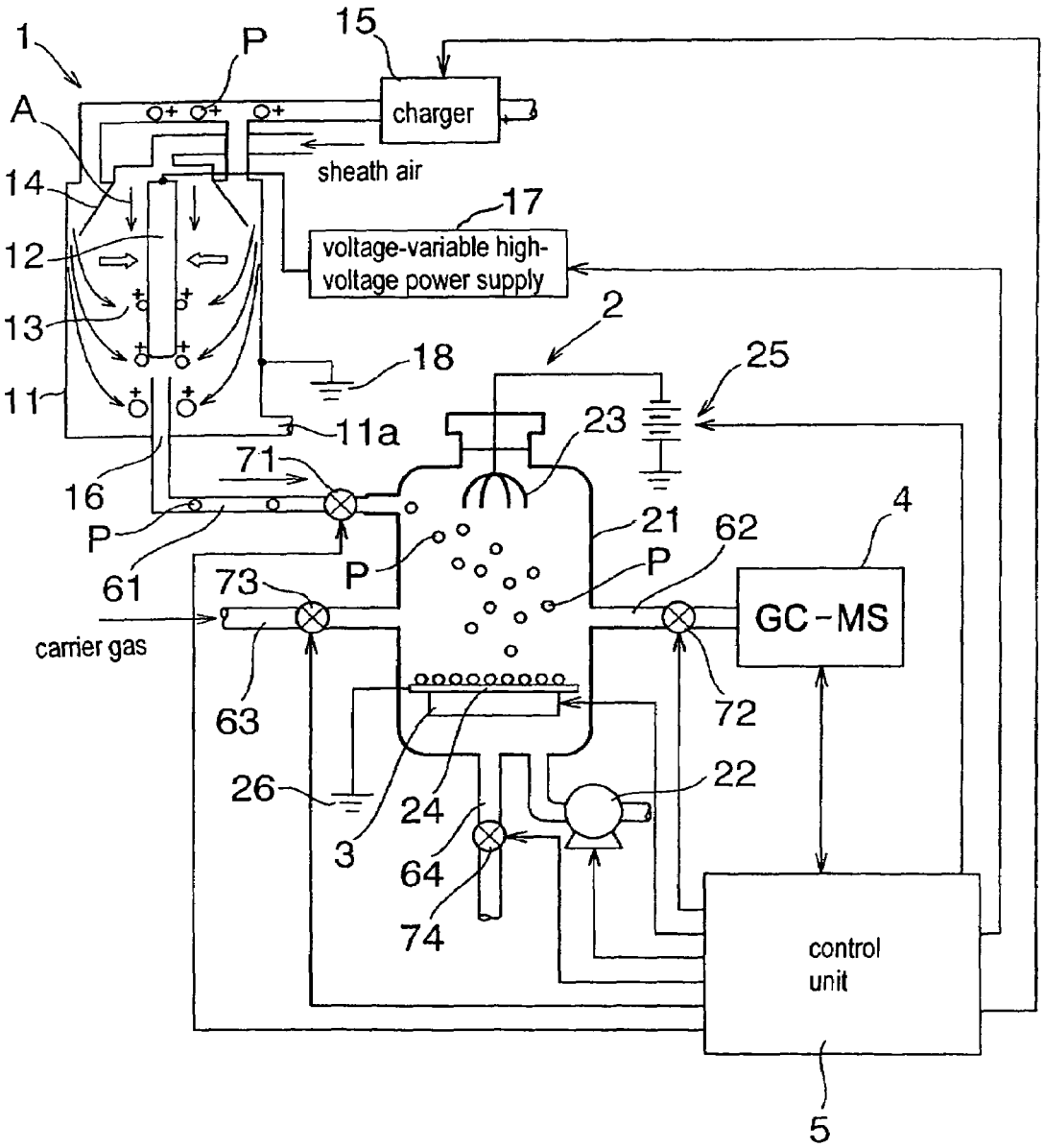
FIG. 1 is a diagram of one embodiment of the present invention including a schematic diagram showing a mechanical structure and a block diagram showing an electrical structure.

In the following, one embodiment of the present invention will be explained with reference to the drawing. FIG. 1 is a diagram of an embodiment of the present invention including a schematic diagram showing the mechanical structure and a block diagram showing the electrical structure.

The apparatus comprises a differential mobility analyzer (DMA) 1, an electrostatic dust collecting type particle collecting unit 2, a heating unit 3 arranged within a container 21 of the particle collecting unit 2, a gas chromatograph mass spectrometer (GC-MS) 4, lines for connecting these components, and a control unit 5 for controlling the entire apparatus.

The differential mobility analyzer 1 has an outer cylinder or housing 11 and an electrode 12 constituting an inner cylinder arranged along the axial center of the outer cylinder, and a passage 13 for air and charged particles P formed in the space between the two. The outer cylinder 11 has an exhaust port 11*a* to vent air contained therein.

A conic guide plate 14 is arranged at the upper end of the outer cylinder 11. Clean sheath air A is supplied on the inside of the guide plate 14, and the air containing suspended particulate materials P is supplied on the outside of the guide plate 14. An outlet 16 composed of a narrow tube is opened at the lower end of the outer cylinder.

The electrode 12 is connected to a voltage-variable high-voltage power supply 17 capable of applying a desired negative high voltage, and the outer cylinder 11 is connected to a grounding electrode 18. In such a construction, suspended particles P to which a certain quantity of positive charge is imparted by a charger 15 are introduced into the outer cylinder 11 via the area on the outside of the guide plate 14, and migrate downward in the passage 13 along the inner wall surface of the outer cylinder 11, as shown in the figure, at a certain rate. In the passage 13, an electric field is formed in the direction that connects the electrode 12 and the outer cylinder 11, and thus, individual particles P flowing perpendicular to the direction of the electric field are influenced by the force that veers them to migrate toward the electrode 12 in the passage 13.

The rate at which the charged particles migrate in the electric field depends on the particle size if all particles have the same charge, and as the particle size becomes smaller, the migration rate becomes higher. Thus, among the particles P flowing in the passage 13, those having smaller particle size adhere to the electrode 12 before reaching the outlet 16, while those having larger particle size arrive at the outlet 16 and are exhausted along with the air from the exhaust port 11*a*. Accordingly, only the particles P that fall within the particle size range corresponding to the voltage applied to the electrode 12 are led to the outlet 16 when the migration rate and the quantity of electric charge are constant.

The outlet 16 of the differential mobility analyzer 1 described above is connected to the container 21 of the electrostatic dust collecting type particle collecting unit 2 via a line 61 and a motorized stop valve 71.

The electrostatic dust collecting type particle collecting unit 2 mainly comprises a container 21, a pump 22 to suck gas into the container 21, a discharging electrode 23 and a dust collecting electrode 24 arranged within the container 21, and a high-voltage power supply 25 to apply a positive high voltage to the discharging electrode 23. The dust collecting electrode 24 is connected to a grounding electrode 26.

In the above construction, when a high voltage is applied to the discharging electrode 23 while operating the pump 22, mono-polar ions generated through ionization of the surrounding air move towards the dust collecting electrode 24 due to the potential difference between the two electrodes, and in this process, come in contact with and charge the particles P contained in the air that has been sucked into the container 21. Likewise, the charged particles P are collected on the collecting electrode 24 due to the potential difference between the discharge electrode 23 and the collecting electrode 24.

In the container 21 of the particle collecting unit 2, a heating unit 3 to heat the collecting electrode 24 from below is arranged. Operating the heating unit 3 can heat the particles P collected on the collecting electrode 24 to separate the volatile components contained therein.

The container 21 of the particle collecting unit 2 is connected to a gas chromatograph mass spectrometer 4 via a line 62 and a motorized stop valve 72, and to a carrier gas source (not shown) via a line 63 and a motorized stop valve 73. The container 21 is also provided with an exhaust line 64 furnished with a motorized stop valve 74.

The gas chromatograph mass spectrometer 4 is a known instrument, and thus a detailed explanation is omitted. The components of sampled air introduced by using a carrier gas as the moving phase are separated according to the difference in adsorption to a stationary solid phase or the distribution or partition coefficients relative to a stationary liquid phase in a separation column. The separated components are then directly introduced into the mass spectrometer to be analyzed.

The charger 15 and the voltage-variable high-voltage power supply 17 of the differential mobility analyzer 1, the pump 22 and the high-voltage power supply 25 of the particle collecting unit 2, the heating unit 3, and the motorized stop valves 71-74 disposed in the respective lines in the construction described above are operated and controlled by the control unit 5. The control unit 5 is also connected to the gas chromatograph mass spectrometer 4, and the operation of the two are synchronized.

The operation of the embodiment of the invention constructed as above will be discussed next. The differential mobility analyzer 1 and the pump 22 are operated with only the stop valve 71 open and the stop valves 72, 73, and 74 closed. As a result, among the suspended particulate materials P contained in the atmosphere, only the particles that fall within the particle size range in correspondence with the voltage set by the voltage-variable high-voltage power supply 17 of the differential mobility analyzer 1 are introduced into the container 21 and collected on the collecting element 24.

Next, upon replacing air in the container 21 with a carrier gas by closing the stop valve 71, turning off the pump 22, and opening the stop valves 73 and 74, the particles P collected on the collecting electrode 24 are heated and the volatile components are gasified while closing the stop valve 74 and operating the heating unit 3. The volatile components, together with the carrier gas, are then introduced into the gas chromatograph mass spectrometer 4 by opening the stop valve 72. With this, the volatile components of the particles P collected on the collecting electrode 24 can be analyzed. At this time, the components having various boiling points can be analyzed individually by sequentially changing the heating temperatures of the heating unit 3 from the lower side.

Upon completing the analysis, by maintaining the condition wherein the heating unit 3 is in operation and the stop valve 74 is open until all volatile components of the particle P are gone, and repeating the same steps after the volatile components are gone, the time-series data on the volatile components of the suspended particulate materials P can be obtained.

Moreover, by performing a similar operation by altering the voltage setting of the voltage-variable high-voltage power supply 17 of the differential mobility analyzer 1, the difference in the gaseous components contained in the suspended particulate materials P according to particle size can be detected.

In the embodiment described above, the volatile components are gasified by heating the collected articles P with the heating unit 3, but the heating unit 3 may be replaced with a pressure reducing means to depressurize the container 21 in order to gasify the particles P.

In the embodiment described above, moreover, a gas chromatograph mass spectrometer was used as a gas analyzer. Needless to say, however, other gas analyzers, including a gas chromatograph, for example, may also be used.

In the present invention, the apparatus may also be configured without the differential mobility analyzer 1 positioned upstream of the particle collecting unit 2. In this case, the apparatus is incapable of analyzing volatile components according to particle size, but is capable of carrying out time-series analyses of the volatile components of particulate materials P suspended in the atmosphere collectively.

The disclosure of Japanese Patent Application No. 2004-300915 filed on Oct. 15, 2004 is incorporated in the application.

While the invention has been explained with reference to the specific embodiments of the invention, the explanation is illustrative and the invention is limited only by the appended claims.

What is claimed is:

1. An apparatus for analyzing components of particulate materials suspended in air comprising:

a container into which the air is introduced, said container having a first stop valve for controlling introduction of the air, a second stop valve for controlling supply of the components of the particulate materials, a third stop valve for controlling supply of a carrier gas to the container, and a fourth stop valve for exhausting the air in the container, a discharging electrode arranged in said container to electrically charge the particulate materials contained in the air, a dust collecting electrode arranged in said container to collect charged particulate materials utilizing electric potential difference, means for separating volatile components contained in the particulate materials collected on said dust collecting electrode, and a gas analyzer connected to said container through said second stop valve, into which the volatile components of the particulate materials separated within said container are introduced for analyzing.

2. An apparatus for analyzing components of particulate materials as claimed in claim 1, further comprising a differential mobility analyzer disposed at a gas inlet of the container for selecting a particle size range for the particulate materials suspended in the air to be introduced into the container through the first stop valve.

3. An apparatus for analyzing components of particulate materials as claimed in claim 2, wherein said differential mobility analyzer includes a housing for receiving the air with the particulate materials, and another electrode disposed in the housing for absorbing selected particles.

4. An apparatus for analyzing components of particulate materials as claimed in claim 3, further comprising a variable electric source connected to said another electrode for changing voltage applied thereto, and a charger for providing electric charge to the particulate materials introduced into the housing.

5. An apparatus for analyzing components of particulate materials as claimed in claim 2, wherein said separating means is a heating means for heating said dust collecting electrode to separate the volatile components of the particulate materials collected on said dust collecting electrode.

6. An apparatus for analyzing components of particulate materials as claimed in claim 5, further comprising control means connected to the heating means and the gas analyzer so that the components are sequentially volatilized and introduced into said gas analyzer, from low boiling point components to high boiling point components, by changing heating temperatures of said heating means.

7. An apparatus for analyzing components of particulate materials as claimed in claim 1, wherein said separating means is a pressure reducing means for depressurizing the container to thereby gasify the volatile components.

8. An apparatus for analyzing components of particulate materials as claimed in claim 1, wherein said gas analyzer is a gas chromatograph mass spectrometer.

9. An apparatus for analyzing components of particulate materials as claimed in claim 1, further comprising control means connected to the heating means, the gas analyzer and the first to fourth stop valves, and a pump attached to the container.

10. An apparatus for analyzing components of particulate materials as claimed in claim 9, wherein said control means controls the first to fourth stop valves such that when the air is introduced into the container, the first stop valve is opened and the second to fourth stop valves are closed, and the pump is operated; and when the particulate materials are analyzed, the first and second stop valves are closed, the third and fourth stop valves are opened, the pump is stopped, and the means for separating the volatile components is heated to thereby vaporize the volatile components and provide the volatile components together with the carrier gas to the gas analyzer.

* * * * *